US006550415B2

(12) United States Patent
Lloveres et al.

(10) Patent No.: US 6,550,415 B2
(45) Date of Patent: Apr. 22, 2003

(54) SYSTEM TO KEEP ANY TYPE OF VESSEL AFLOAT IN CASE OF A LEAK

(76) Inventors: Vicente Lopez-Perea Lloveres, San Bartolomé, 12 Pravío-Cambre, E-15668 A Coruña (ES); César Gomez Portela, Escalera B, 2° Izda, María Luisa Durán Marquina, 20, E-15011 A Coruña (ES)

( * ) Notice: Subject to any disclaimer, the term of this patent is extended or adjusted under 35 U.S.C. 154(b) by 0 days.

(21) Appl. No.: 10/172,813

(22) Filed: Jun. 13, 2002

(65) Prior Publication Data

US 2003/0015129 A1 Jan. 23, 2003

Related U.S. Application Data

(63) Continuation-in-part of application No. 09/831,265, filed on Jul. 18, 2001, now Pat. No. 6,431,108.

(51) Int. Cl.[7] ..... B63B 43/02

(52) U.S. Cl. ..... 114/360; 114/360; 114/68; 114/123

(58) Field of Search ..... 114/360, 68, 123

(56) References Cited

U.S. PATENT DOCUMENTS 3,340,842 A * 9/1967 Winslow ..... 114/360
3,440,989 A * 4/1969 Ettinger ..... 114/360
4,864,961 A * 9/1989 Slonski ..... 114/360

* cited by examiner

*Primary Examiner*—Ed Swinehart
(74) *Attorney, Agent, or Firm*—Sheridan Ross PC

(57) ABSTRACT

A system to keep any type of vessel afloat in case of entry of water or capsizing by means of providing an unfolding mechanism of inflatable flotation and stabilization elements through the outside of the hull of the vessel, including a variety of devices that are actuated automatically or manually if necessary when a water level or inclination meter inside the vessel detects that water has reached a maximum permitted level or an excessive inclination occurs, which causes the opening of an electrically operated valve to allow pressurized fluid to pass in order to unfold said flotation and stabilization elements. Alternatively, another unfolding mechanism may consist of a pair of cylinders screwed to one another, through the wall of the hull, the interior cylinder of which encloses the flotation and stabilization elements and the exterior cylinder of which includes a cover on its outside face that can be ejected by the pressure exerted from the interior.

5 Claims, 4 Drawing Sheets

SYSTEM TO KEEP ANY TYPE OF VESSEL AFLOAT IN CASE OF A LEAK

CROSS REFERENCE TO RELATED APPLICATIONS

This application is a continuation-in-part application of U.S. application Ser. No. 09/831,265, filed on Jul. 18, 2001, U.S. Pat. No. 6,431,108.

DESCRIPTION

1. Purpose of the Invention

This invention relates to a system to keep any type of vessel afloat when an emergency situation arises caused by the appearance of the entry of water, a collision, filtration, grounding, excessive rolling or pitching or any other situation, which provides essential new characteristics and notable advantages with respect to the systems that are known and used in the current state of the art.

More specifically, the invention proposes the development of a system that provides sufficient flotation and stabilization elements (hereinafter referred to as "inflatable elements") that are adequately effective in preventing the sinking of a vessel when an emergency like those specified above occurs. Activation is automatic or manual as selected, when the entry of water into the vessel has been detected or when the inclination of the vessel is excessive, and once the water has reached a predetermined level the extent of the excessive inclination has reached a predetermined value or a threshold of any other type has been likewise reached, said system providing inflatable elements which are selectively automatically inflated with the appropriate fluid and are in charge of keeping the vessel afloat and avoiding capsizing for the time needed for different rescue, towing and/or repair operations, maintaining in the most cases sufficient residual capabilities for steering control.

This system allows adequate time for possible damage repair while guaranteeing the floatability and stability of the vessel. Most important, the system guarantees the surviving of the crew during a quite long period of time.

The field of application of the invention is in the naval industry dedicated to the manufacture and/or maintenance of ships, recreational and/or fishing boats and the like, as well as the rescue equipment thereto.

2. Background and Summary of the Invention

It is a known fact that at certain times and with some frequency, very dangerous situations arise on the high seas, caused by breakage, malfunctions, leaks, accidents, etc. in which vessels are sometimes involved. These types of situations are normally very difficult to resolve, keeping in mind the difficulties to access the places in which they occur, regardless of whether this is done by sea or by air, and specially when it involves a large number of people; for this reason, many of these problems often end in catastrophe, at least for part of the people involved.

Many vessels have some means among their customary auxiliary equipment aimed at being used in rescue operations if necessary, such as lifeboats or even individual inflatable elements. Although these methods have been effective in some situations, the truth is that they have always been shown to be insufficient, and useless in many cases, if they cannot be used due to the speed with which the catastrophe develops.

Anti-shipwreck systems are known, of the type that incorporate one or several floats coupled outside the vessel, which increases the beam and which can be inflated with pressurized air when a situation of extreme danger arises in the case of a leak (Spanish utility model U9403303).

These floats or inflating elements are found in grooves superimposed along the hull of the vessel (European patent EP-A-0487527); in other cases, these elements are housed even in the inside in a net wrapping (Spanish patent P9302462).

U.S. Pat. No. 3,440,989 describes a fully organized, self-contained flotation unit adapted to be mounted inside a compartment of a boat, conveniently attached to the ceiling of the craft's compartment, and deploying the floating elements inside the craft's compartment.

However, there are certain problems associated with the aforementioned devices and systems, such as the appearance of possible fissures, cracks, piercing or fractures in the protection means of the inflating elements, due to permanent direct contact with the seawater, due to contact with docks, due to climatic factors, or due to be inflated inside the boat, which may endanger the proper functioning of the anti-shipwreck system and, in some cases, the safety of the people aboard.

Yet another known problem with prior art systems is that once an emergency situation arises and the system comes into operation, all inflating elements simultaneously deploy. This implies a waste of resources as many times only some of them are really necessary to overcome the emergency situation.

Other security systems use high-pressure gas to fill the inflating elements, with the high risk of explosion or fire that this involves.

Therefore, there is real need in practice for effective auxiliary and/or complementary systems to solve the problems of the aforementioned types, in particular when these problems represent an effective risk of loss of human life and/or economic losses.

The main object of this invention is the provision of a flotation system that is quickly activated, is able to anticipate any danger situation, and prevents a real risk for people, as well as being automatic if it is convenient, without the need for any intervention of the personnel on the vessel, once there is a particular elevation in the water level inside the vessel or a severe inclination of the vessel, and which will provide the means that will be capable of keeping the vessel afloat and/or stabilized for the time needed for rescue and/or repair and/or towing the vessel to a safe place, as mentioned above, therefore solving the problems that exist in the known systems to obtain flotation of vessels without the requirement of auxiliary systems.

In accordance with the invention, these objectives are fully achieved with the planned system, which develops a system that can selectively deploy a plurality of inflatable elements, in variable number depending on the type of vessel, on the outside of the hull, connected in a suitable ratio with a plurality of pressurized fluid containers and vertically and horizontally located along the side of the vessel depending on structural and dimensional aspects of the characteristics of the zone of the vessel where they are positioned. To this purpose, the system foresees the use of detection devices inside the vessel to detect the height progressively reached by the water and/or the inclination extent, e.g. in time or angular position, so that once a predetermined threshold is reached, an automatic deployment mechanism is triggered. This triggering is provided by the opening of electrically operated valves, which supply a pressurized fluid contained in one or more tanks at a specific pressure and which, through the proper piping, is delivered to the devices that house the aforementioned inflatable elements, in order to deploy such devices and, if required, maintain such devices at a constant specific pressure.

The practical realization of the system of the present invention allows for several possibilities, which may be done with devices enclosed in the vessel and connected to the internal activation system with the proper pipes, these devices being able to have access to the outside through a predetermined area when an emergency situation arises.

As will be shown later, the characteristics inherent in each type of embodiment differ, which means that in each specific case, one or the other may be chosen depending on specific needs.

According to the invention, a possible embodiment would include a mechanism enclosed inside a cylindrical body, capable of axial movement inside the cylindrical body when pushed by the pressurized fluid, and able to exit through a controlled area of the hull of the vessel and thereby allow the deployment of the inflatable elements. Many of these mechanisms will be arranged inside the hull of the vessel, as many as are deemed necessary to maintain the stability and flotation of the vessel in case of need, separated from one another by a predetermined distance.

Another possible embodiment has been planned to use a device that is made up of two cylinders that can be screwed together, which enclose the unfolding inflatable elements. The external cylinder has a base of larger diameter, which is adjusted to the exterior part of the hull of the vessel. This base includes a pressurized sealed closure that is adapted thereto, which allows the inflatable element to unfold when pushed by the inflatable element itself by virtue of the incoming pressurized fluid.

Both embodiments resolve the above mentioned problems since they offer the possibility of housing the inflatable elements inside the vessel, which will prevent the inflatable elements from suffering any deterioration and will guarantee the perfect functioning of the system.

Also, the installation of the system only requires, at most, a minor physical or aesthetic alteration of the hull of the vessel; the inflatable elements do not suffer any deterioration; and there is no risk of explosion, as occurs with other systems.

Consequently, this system is more commercially acceptable.

Therefore, a system as developed by this invention can perfectly fulfill the mission of keeping the vessel afloat in case of a leak or a severe inclination (resulting from breakdown, load-slide, heavy sea or a similar occurrence), becoming a very versatile system with very broad possibilities for use.

BRIEF DESCRIPTION OF THE DRAWINGS

Further characteristics and advantages of the invention will become clear in the description of the embodiments of the invention that follows, given by way of non limiting example, with reference to the illustrative accompanying drawings, in which.

DESCRIPTION OF THE INVENTION

Figure 1:
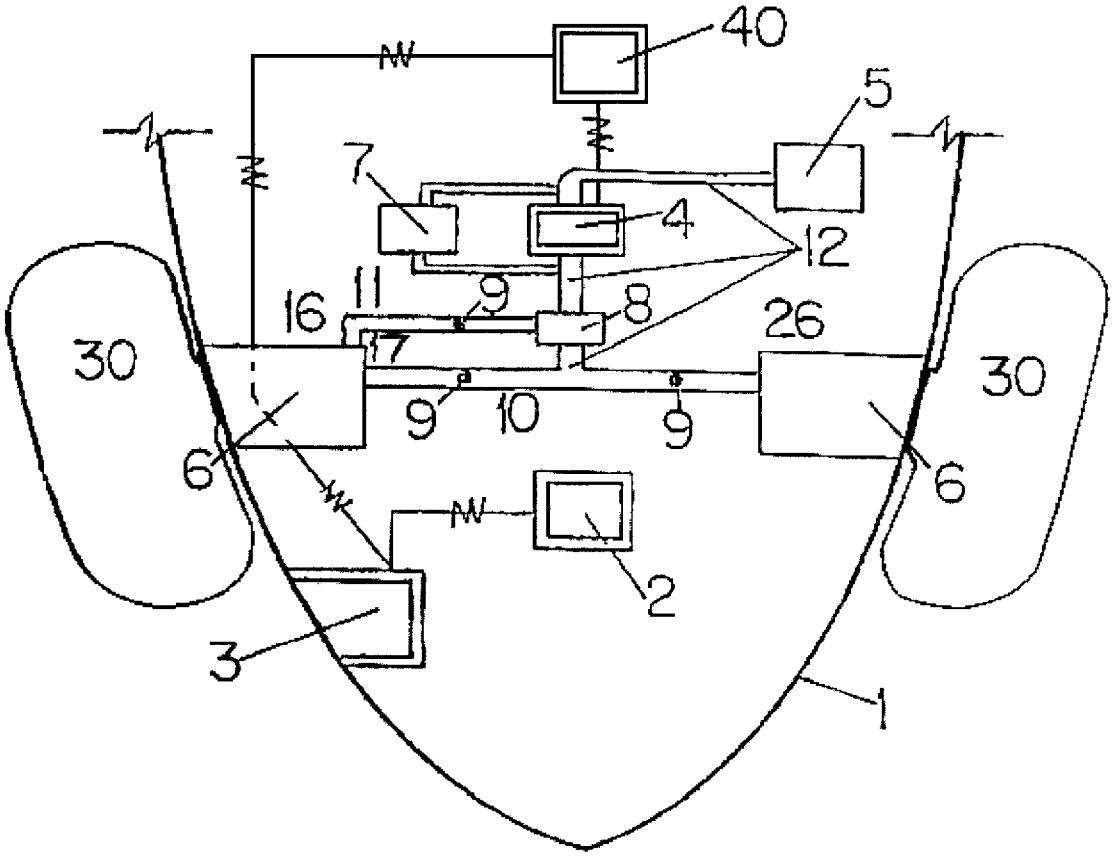
FIG. 1 shows a schematic view of the activation and triggering system of the invention.

The description that follows of two possible embodiments of this invention will make continuous reference to the different figures of the drawings, in which the same reference numerals have been used to designate like parts.

Referring to FIG. 1, it shows a schematic representation of a system according to the invention, enclosed in the interior space provided by the hull (1) of any type of vessel, and in which the different parts that make it up have been shown as blocks. The system is made up of two clearly differentiated parts, consisting of an electrical section and a pneumatic-mechanical section.

The electrical part is made up of a power source (2) that provides the electrical energy needed to feed the different components, and may be recharged with the proper means, a device (3) that detects the level of the water in the hull or the extent of the inclination of the vessel, transmitting a signal to a control unit (40) which in turn drive an electrically operated valve (4) in charge of allowing the passage of fluid held in tanks (5) on board. The device (3) is activated either by virtue of the position that a flow meter associated with device (3) indicates progressively as water enters the interior of the vessel, or the inclination characteristics that an inclination meter associated with device (3) indicates.

Regarding the pneumatic-mechanical part, it comprises the tank (5) that holds the fluid for delivery through pipes (12) in order to deploy the inflatable elements (30), the electrically operated valve (4), a valve (7) of the bypass type, preferably manually activated, a regulation valve (8) designed to regulate the pressure in the circuits (10, 11) of fluid intake to the devices (6) to deploy the inflatable elements (30), retention valves (9) located at the intake pipes (10, 11) to the deployment devices (6) of the inflatable elements (30), and the devices (6) themselves, with the inflatable elements (30) themselves for the beam expansion, varying in number.

Although only one module is shown in the drawing for the sake of simplicity, a plurality of modules are usually to be provided in a vessel under the command of a single common control unit (40). To be more precise, the system activation is selective. The control unit (40) makes the selection in accordance with the number and situation of the flotation elements that must be activated as resulting from the different signals processed.

The operation of the system is as follows: when water enters the vessel (1) or the vessel (1) undergoes acute inclination, caused by some accidental circumstance, detectors (3) of the relevant zone of the vessel detect this situation by means of the measuring element associated with said detectors (3), so that when a particular threshold is reached corresponding to a maximum predetermined value, these detectors (3) close the circuit, accordingly sending a warning signal to the control unit (40) which automatically leads to selectively opening of the relevant electrically operated valves (4) and allows the passage of the pressurized fluid held in the associated containers (5).

An inclinometer, a flow meter, or any other detecting device may drive the system activation.

The mechanism has bypass valves (7), which enable manually opening of the passage of the pressurized fluid held in the containers (5).

Thus, the pressurized fluid circulates through the pipes (12), passing through the pressure regulators (8) and the properly adjusted retention valves (9), finally reaching the housing devices (6) through the intake pipes (10 or 11).

At this point in operation, the respective inflatable elements (30) start unfolding, subsequently completely deploying outside the hull of the vessel.

The operation of the system is then selective, as regards number and position of the modules, in accordance with the selection performed by the control unit (40) resulting from the signals received from the various detecting elements (3).

By way of example only, small vessels without watertight bulkhead subdivision will be normally provided with a plurality of deployment devices (6) with corresponding inflatable elements (30) arranged so as to form a substantially horizontal single line in the hull, above, on or below the flotation line (F.L.) of the vessel, generally regularly spaced apart from each other.

In other cases, the arrangement of deployment devices (6) housing the inflatable elements (30) in watertight compartmented vessels may be very variable, becoming in some cases a horizontally staggered line in the hull of the vessel, above, on and below the flotation line, 4 unevenly spaced apart from each other, depending on the stability and flotation requirements of each zone of the vessel.

According to the invention, the deployment device (6) of the inflatable elements (30) may take different forms, without affecting the rest of the system. Indeed, the pressurized fluid provided when the predetermined water level is reached in the interior of the vessel o when a sever inclination occurs, may be applied to any mechanism capable of performing this function of deploying the inflatable elements (30) on the outside of the vessel.

Figure 2:
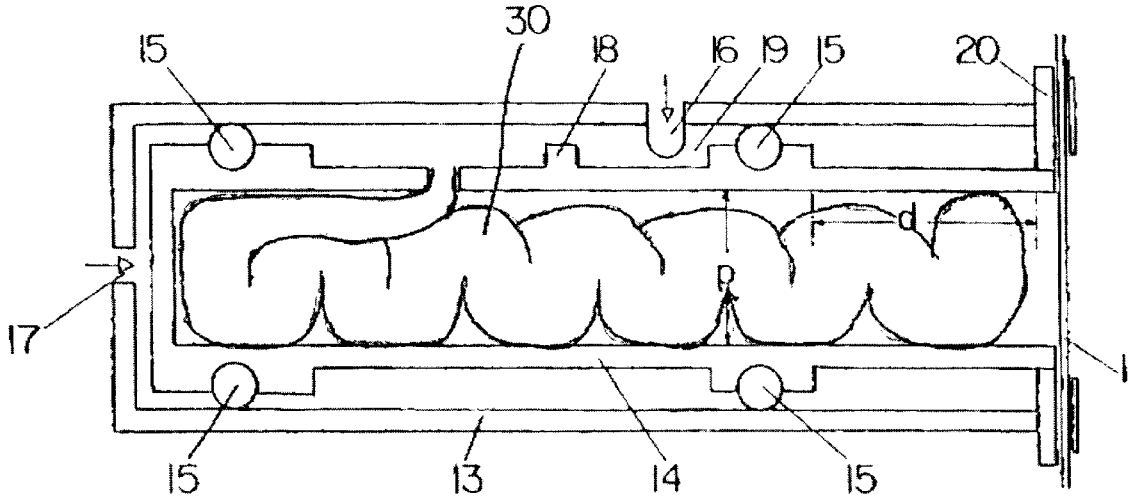
FIG. 2 shows a schematic cross-sectional view of a possible embodiment of the housing and ejecting device for the inflatable element.

FIG. 2 shows an example of the arrangement of a relevant mechanism for the purposes of the invention, and which has been constituted as a first cylindrical exterior body (13) in whose interior an element (14) is housed, with the same cylindrical shape, and inside which the deployment mechanism is housed, and which can be moved inside the first cylindrical body when subjected to the push of the pressurized fluid introduced by openings such as those described (16, 17) in this Figure. This mechanism is included inside each device (6) described with reference to FIG. 1. This way, when the means (3) of any type causes the opening of the electrically operated valve (4), the pressurized fluid held in the container (5) circulates through the pipes continuously to the openings (16, 17).

The regulation valve or valves (8) are, at this point, in charge of regulating the intake pressure of the fluid at each of the openings (16 and 17). The intake of the pressurized fluid through the opening (17) to the inside of the cylinder (13) causes the movement of the cylinder (14) inside the external cylinder (13) towards the outside of the hull. In other words, the valve or valves (8) select, on one hand, the fluid pressure at the opening (17), needed to cause the movement of the cylinder (14) along the distance (d), and on the other hand, the pressure of the fluid that enters through the opening (16) needed to cause the unfolding of the inflatable elements (30), as discussed below.

The trajectory of the run of the cylinder (14), or in other words, the distance (d), causes, on one hand, the breaking of the bladder (19) by means of the ridge (18), and on the other hand, the exit to the exterior of the cylinder through the area (p) preset in the hull of the vessel.

It must be understood that the preset area, as indicated (p) in FIG. 2, corresponds to a controlled area of the hull of the vessel, with a diameter approximately equal to the diameter of the cylinder (14), which is reinforced in its outside perimeter with a suitable material that prevents the uncontrolled breaking of the hull when the cylinder (14) is pushed to the outside by the pressurized fluid.

In turn, the movement of the cylinder (14), once it has covered the distance (d), activates the entrance of fluid through the opening (16) to the interior of the cylinder (14). This fluid, therefore, will act by allowing the inflatable elements (30) located inside the cylinder (14) to be deployed.

As shown in the Figure, the seal of both cylindrical bodies, to prevent the pressurized fluid that enters from either of the openings (16, 17) form escaping, is guaranteed by the O-rings (15) located at pre-established points between these bodies (13, 14).

Figure 3:
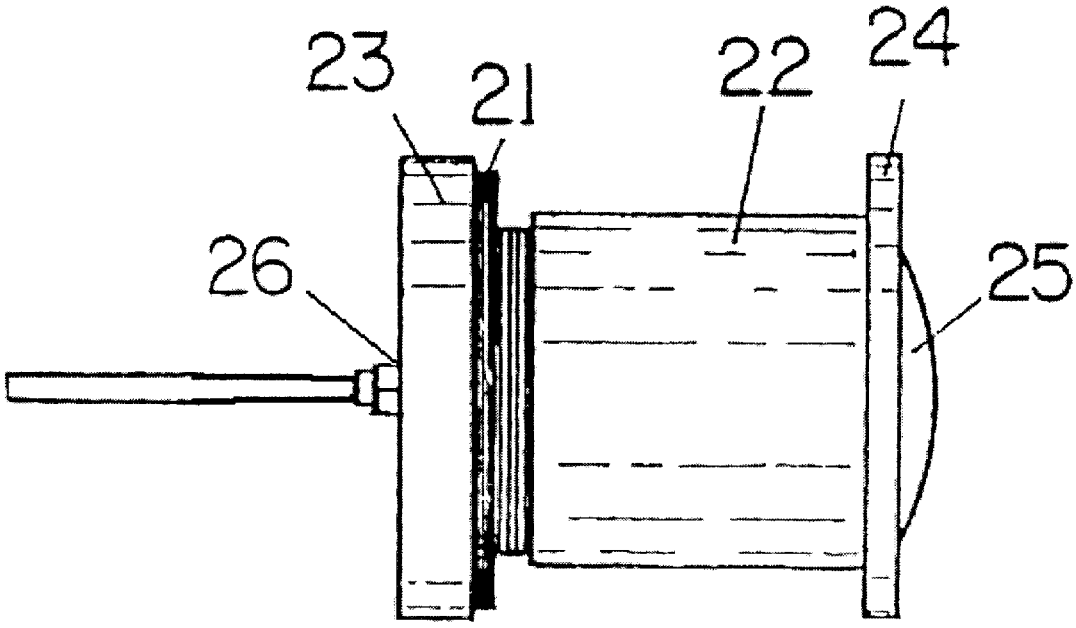
FIG. 3 shows a schematic view of another possible embodiment of the housing and ejecting device for the inflatable element.
Figure 4:
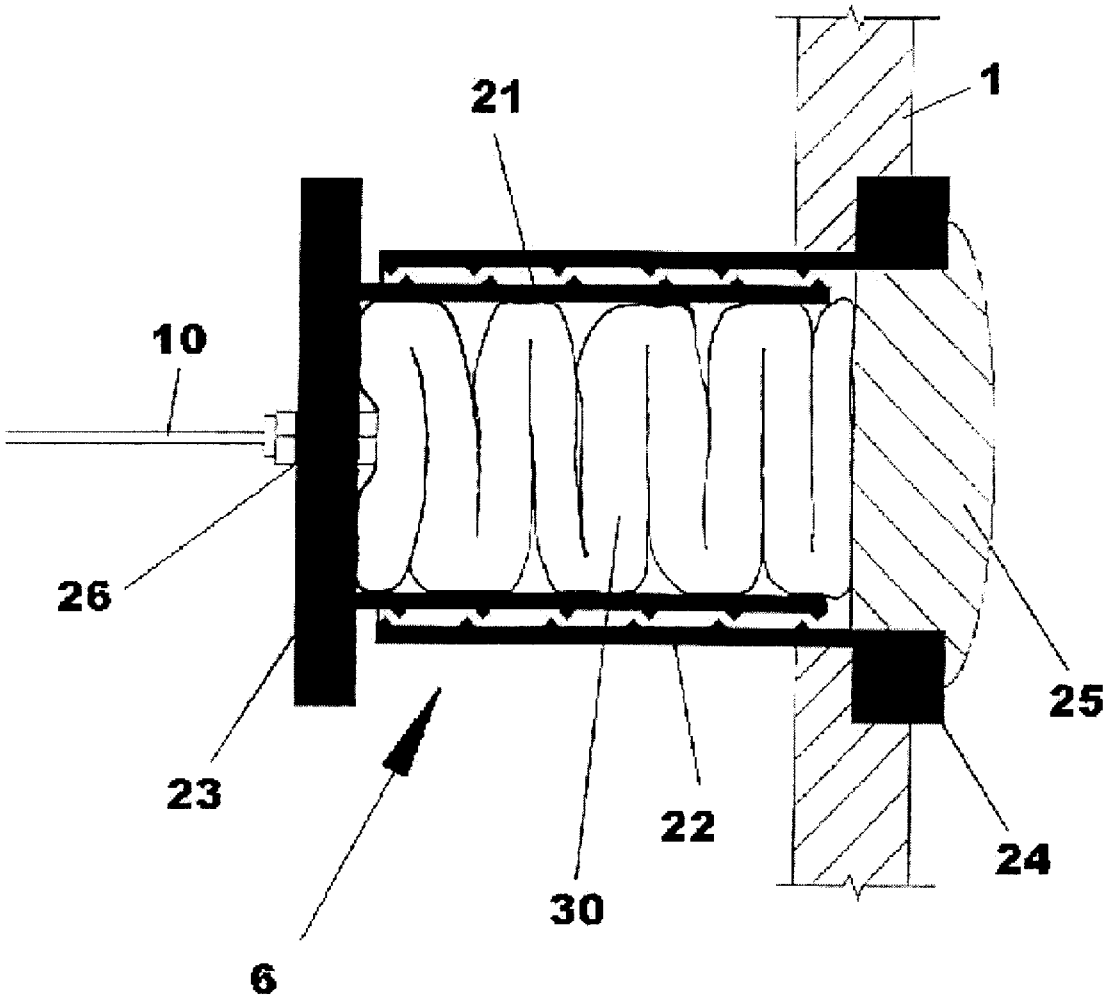
FIG. 4 shows a schematic cross-sectional view of the embodiment of FIG. 3 in installed position.

FIGS. 3 and 4 show another embodiment in which the unfolding mechanism of the inflatable elements (30) consists of two cylinders (21, 22) that can be screwed together by means of providing, respectively, an internal and external threaded area, whose bases have a diameter grater than the diameter of the cylinders themselves. This way, the larger diameter base of the exterior cylinder (22) allows the adaptation and attachment to the external face of the hull of the vessel, as shown in the aforementioned FIG. 4.

The base (24) of the external cylinder also includes a pressurized closure (25), acting as a cover, without essentially protruding from the base; this cover will be ejected by the push caused by the pressure of the fluid introduced through the opening (26), leaving the inflatable element (30) located on the inside of the internal cylinder (22) free; this inflatable element (30) in turn expands by means of the entry of the pressurized fluid.

Referring particularly to FIG. 4, that is shown in a basic illustrative way, the housing device (6) consist of two cylinders (21, 22), the outer cylinder (22) having an open base (24) fixedly attached to a recess on the exterior surface of the hull of the vessel and an internal thread and the inner cylinder (21) having a solid base (23) only centrally apertured to allow the passage of intake pipe (10) therethrough and an external thread. The inflatable element (30) is located inside the cylinders (21, 22), in the folded state, compressed as a result of screwing the inner cylinder (21) in the outer cylinder (22), and is retained therein by means of a cap-shaped snap-fit end closure (25).

Unfolding inflatable elements (30) designed for the flotation and stabilization of the vessel according to this invention are considered to be all those inflatable elements capable of increasing the stability and flotation surface of the vessel by filling themselves with the fluid supplied at pressure as indicated above. These inflatable elements (30) are made up of composite material selected according to the size and pressure withstood. These inflatable elements (30) are made in accordance with the general regulations of the Safety Of Life At Sea (SOLAS) publication.

Naturally, the principle of the invention remaining the same, the details of construction and forms of embodiment may be widely varied with respect to those described and illustrated, without thereby departing from the scope of the present invention.

What is claimed is:

1. A system to keep any type of vessel afloat in case of emergency situation, which comprises a plurality of modules consisting of:

an electrical part or section, comprising: a power source that supplies electrical energy to the system, a detection device that detects the level of the water in the hull or the extent of the inclination of the vessel, and a electrically operated valve and a pneumatic-mechanical part or section, comprising: inflatable elements, devices for housing and deploying respective inflatable elements, tanks that hold pressurized fluid to be delivered through pipes to the deployment devices, the electrically operated valve, valves of the bypass type bypassing the electrically operated valve, a regulation valve designed to regulate the pressure in pipes of fluid intake to the deployment devices, retention valves located at the intake pipes to the deployment devices;

characterized in that a control unit is connected to a plurality of modules, receiving signals from each detection device associated with each module and selectively sending corresponding commands to electrically operated valves in order to selectively activate the necessary modules in accordance with the situation in progress.

2. System according to claim 1, wherein the control unit is an electronic processor.

3. System according to claim 1 wherein deployment devices are arranged so as to form a substantially horizontal single line in the hull, above, on or below the flotation line of the vessel, generally regularly spaced apart from each other.

4. System according to claim 1, wherein deployment devices are arranged so as to form a horizontally staggered line in the hull of the vessel, above, on and below the flotation line of the vessel, unevenly spaced apart from each other.

5. System according to claim 1, wherein some flotation elements are maintained at a constant pressure in operational state.

* * * * *